United States Patent [19]

Bohlman

[11] Patent Number: 4,813,711

[45] Date of Patent: Mar. 21, 1989

[54] VIDEO TAPE INDEX

[76] Inventor: Ronald J. Bohlman, 124 E. Twelfth St., Fond du Lac, Wis. 54935

[21] Appl. No.: 17,680

[22] Filed: Feb. 24, 1987

[51] Int. Cl.[4] ..... B42D 15/00

[52] U.S. Cl. ..... 283/81; 253/900; 253/36; 434/408

[58] Field of Search ..... 283/81, 36, 900; 281/26, 34, 39, 44; 434/50, 408; 402/21; 40/2 R, 615; 259/74, 75

[56] References Cited

U.S. PATENT DOCUMENTS

| | | | |
|---|---|---|---|
| 1,317,925 | 10/1919 | Kent | 283/36 |
| 3,642,191 | 2/1972 | Roof | 434/408 |
| 3,836,414 | 9/1974 | Staats | 156/152 |

FOREIGN PATENT DOCUMENTS

| | | | |
|---|---|---|---|
| 2250281 | 5/1975 | France | 283/900 |
| 2055702 | 3/1981 | United Kingdom | 283/81 |

*Primary Examiner*—Paul A. Bell
*Attorney, Agent, or Firm*—Donald Cayen

[57] ABSTRACT

A video tape index conveniently catalogs programs on a video tape cassette. The index comprises an indexing card laminate having a core ply printed with grids and headings suitable for organizing information pertinent to video tape programs. Clear films are bonded to the core ply. The outer surfaces of the clear films have matte finishes suitable for accepting a writing instrument. If the information is written in pencil, the entered information can be easily erased and replaced when the cassette programs are changed. The indexing card further comprises a calender for listing information pertinent to further programs to be recorded. The indexing card also contains a calibration chart for correlating equipment counter readouts with elapsed time.

7 Claims, 2 Drawing Sheets

VIDEO TAPE INDEX

BACKGROUND OF THE INVENTION

1. Field of the Invention

This invention pertains to indexing devices, and more particularly to apparatus for changeably indexing media information.

2. Description of the Prior Art

The rapid growth of the video recording industry is well known. The popularity of video recordings extends to home use of video cassettes for entertainment and educational purposes. Whether the programs are purchased or recorded by the viewer, video cassettes provide inexpensive high-quality entertainment and teaching aids.

With the accumulation of video tape cassettes, it becomes necessary to organize them in some way so as to maximize their usefulness. Physically storing the cassettes is usually little or no problem, because cassette files are readily available. On the other hand, organizing the programs contained on the cassettes, as distinguished from organizing the cassettes themselves, is a much more difficult task. That is particularly true with programs that are recorded by the home viewer, as several programs are often recorded on one cassette.

Keeping track of the home recorded programs on a cassette is especially troublesome if the programs are frequently erased and replaced with new programs. Writing, erasing, and rewriting program titles on the cassette box or on a cassette label is unsatisfactory, because the box or label soon becomes unsightly and even unuseable. Constantly erasing separate sheets of paper causes them to tear; loose paper sheets also are readily lost. Crossing out previously written titles on a box, label, or separate paper and then writing in new program information can quickly consume the space available on the sheet or label. Moreover, it is confusing to search for a particular program on a sheet that combines crossouts with current program titles.

Thus, a need exists for means to conveniently organize on a continuous basis the programs contained on video tape cassettes.

SUMMARY OF THE INVENTION

In accordance with the present invention, a long lasting and inexpensive video tape index is provided that permits cataloging the programs contained on each of several video tape cassettes in correlation with changes in those programs. This is accomplished by apparatus that includes a card of writeable and erasable material that is preprinted so as to permit easy entry and organization of information pertaining to the cassette programs.

The card is preferably a three ply laminate. The core ply may be a vinyl material having sufficient hardness and rigidity to be written on. The core ply first side is printed with a series of vertical and horizontal lines that divide the card into a grid-like pattern of columns and rows.

The columns on the first side include a first column of spaces that correspond to the cassettes in the owner's library that are to be indexed. Each space for the particular cassette to be cataloged is assigned two rows. Each row has 12 additional columns. The second, sixth, and tenth columns of each of the two rows are used for entering the titles of the programs on the cassette listed in the first column. Thus, the card contains space for listing up to six programs for each cassette listed in the first column. The third, seventh, and eleventh columns are used to enter the ratings associated with each program. The fourth, eighth, and twelfth columns contain the counter reading of the user's video playing machine corresponding to the beginning of the respective programs. The fifth, ninth, and thirteenth columns contain the running time of the individual programs. Appropriate headings are printed at the top of each of the thirteen columns.

While the card may be of any convenient size, it has been found that sixteen double rows on the card first side is sufficient. That is, the first column contains spaces for sixteen cassettes, which means that 96 programs can be cataloged on the first side.

The second side of the core ply preferably is divided horizontally into two approximately equal areas. The top half is printed with a grid-like pattern of rows and columns, together with corresponding headings, substantially identical to that described previously on the first side, except that space for cataloging eight cassettes is provided. The bottom half of the second side is divided vertically into two distinct sections. The lower half of the left side is printed with a grid-like pattern that forms a calendar of future programs to be recorded. Eight rows corresponding to eight programs to be taped may be printed. For each row, there are five columns that provide space for inserting the date, the program title to be taped, the start and stop times, and the television channel.

The right side of the bottom half of the second core ply side is printed with a table for calibrating the user's particular equipment with time. A number of indicia corresponding with time intervals are provided. Adjacent each printed time related indicia is a space in which the user enters the counter reading corresponding with tape advancement during the particular time interval. Thus, the user can immediately convert a time interval into a readout on his equipment counter.

Further in accordance with the present invention, both sides of the core ply are covered with a clear vinyl film, the outside surfaces of which have matte finishes. The matte finishes are adapted to accept hand writing from a writing instrument. The user writes the information pertaining to his situation on the matte finish within the appropriate rows and columns printed on the core ply. The preferred writing medium is pencil, because pencil is neatly eraseable from the matte finish. In that manner, program information is easily removed or added to the index when a corresponding program is deleted or added to a cassette. Consequently, the index of the present invention can accept almost unlimited library changes while retaining a fresh and neat appearance.

The matte finish need not cover the entire card. The headings and other printing that are not changed by the user may be covered with a high gloss finish material. The high gloss areas may be especially desireable for providing maximum durability to the card margins.

Other aims and advantages of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 3:
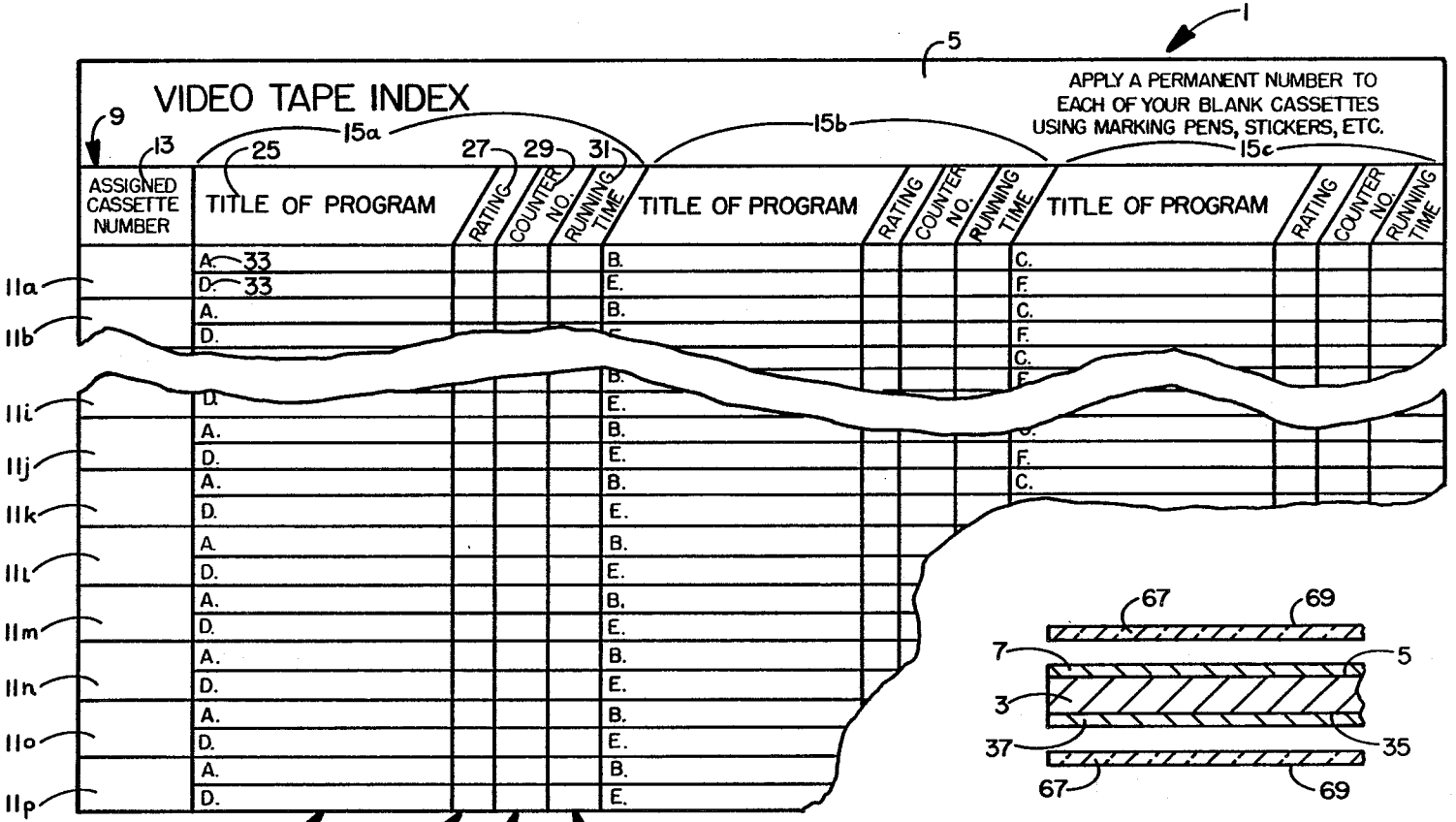
FIG. 1 is a front view of the video tape index of the present invention.
FIG. 3 is a cross sectional view taken along lines 3—3 of FIG. 2.
Figure 2:
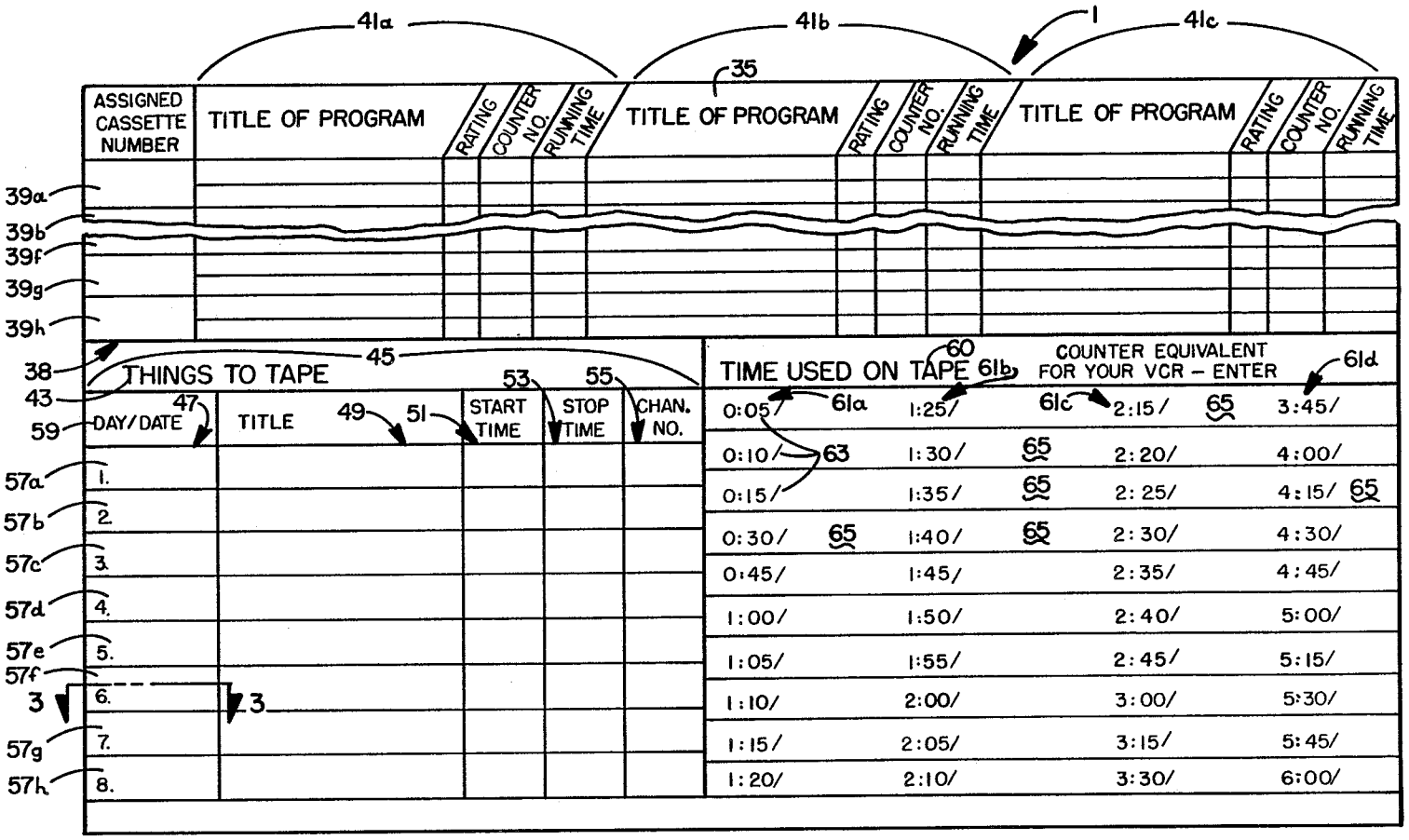
FIG. 2 is a back view of the video tape index of the present invention.

Referring to FIGS. 1–3, an indexing card 1 is illustrated that includes the present invention. The indexing card is particularly useful for cataloging programs recorded on video tape cassettes, but it will be understood that the invention is not limited to television related applications.

The indexing card 1 may be fabricated from a single piece of flat material. Preferably, however, the indexing card is made as a three-ply laminate. The core ply 3 may be of a vinyl material. The core ply 3 has sufficient hardness and rigidity to enable a person to write on the indexing card without requiring a support surface. Both sides of the core ply are printed in indelible ink with information suitable for assisting a person organize his library of video tape cassettes. For that purpose, the front side 5 of the core ply is printed with ink 7 in the arrangement best shown in FIG. 1. The first side 5 is ruled with vertical and horizontal lines so as to produce a grid-like pattern of columns and rows.

The left column 9 comprises sixteen rows of spaces 11*a*–11*p*. The number of rows of spaces 11 is not critical; more or fewer rows than 16 are possible. A heading 13 "Assigned Cassette Number" or words of similar meaning is printed at the top of the column 9.

The remainder of the first side 5 of the indexing card 1 is divided into arrays 15 of rows and columns. In FIG. 1, three arrays 15*a*–15*c* are illustrated, but more or fewer arrays are possible. Each array 15 comprises four columns 17, 19, 21, and 23. Each column 17, 19, 21, and 23 is divided into a number of equispaced rows equal to two times the number of rows of spaces 11 in column 9. Thus, FIG. 1 illustrates 32 rows in each of the arrays 15. The columns are of unequal width, with column 17 being the widest, column 19 being the narrowest, and columns 21 and 23 being of approximately equal width and slightly wider than column 19. Above the column 17 is printed a heading 25 bearing the words "Title of Program." The heading 27 for column 19 is titled "Rating." The heading 29 for column 21 is "Counter Number." The heading 31 for column 23 is "Running Time." The arrays 15*b* and 15*c* are substantially identical to the array 15*a*. For clarity, the reference numerals corresponding to those depicted for array 15*a* have been omitted from arrays 15*b* and 15*c*. Preferably, different letters or other indicia 33 are placed at the left end of each of the two rows in column 17 associated with each space 11. With three arrays 15, six indicia 33 are employed for each space 11; with 16 spaces 11, a total of 96 indicia 33 are present. Although not shown in FIG. 1 for clarity purposes, instructions for using the indexing card 1 of the present invention, as will be explained hereinafter, are imprinted in the margin above the arrays.

Turning to FIG. 2, the back side 35 of the core ply 3 is depicted. The back side 35 is printed with ink 37 (FIG. 3), in a manner generally similar to the front side 5. However, in the preferred embodiment the printing 37 is applied so as to divide the back side horizontally into two approximately equal areas. The top area is printed with a column 38 containing eight rows of spaces 39*a*–39*h* substantially identical to the spaces 11*a*–11*o* on the front side. The top area of the back side is also printed with arrays 41*a*–41*c* substantially identical to the arays 15*a*–15*c* on the front side. The headings at the top of the columns in the arrays 41*a*–41*c* also correspond to the respective headings 13, 25, 27, 29, and 31 on the front side. Consequently, information pertaining to 48 video programs can be cataloged on the back side of the indexing card 1.

The lower area of the back side 35 is divided vertically into two additional sections. The lower left section is printed so as to provide a calendar suitable for entering information regarding video programs a person wishes to record in the future. For that purpose, the left lower section contains a title 43 bearing the words "Things to Tape," or words of similar meaning. Under the title 43 is an array 45 of five columns 47, 49, 51, 53, and 55, together with rows 57*a*–57*h*. Eight rows 57 are depicted, but more or fewer rows are possible. At the top of each column 47, 49, 51, 53, and 55 are printed respective headings typically represented by reference numeral 59. The headings are labeled "Day/Date," "Title," "Start Time," "Stop Time," and "Channel Number."

The right half of the lower section on the back side 35 is printed with a calibration chart for correlating elapsed time with counter readout on the user's playing machine. The calibration chart comprises a heading 60 bearing the words "Time Used on Tape" or similar words. The calibration chart shown in FIG. 2 also contains four columns 61*a*–61*d*. In each column 61*a*–61*d* are printed ten rows of digits 63. The digits 63 are in the form of time, i.e., 0:05, 0:10, 0:15, which represent minutes, up to 6:00, or 6 hours. Adjacent each digit 63 is a blank space 65.

Further in accordance with the present invention, the front and back sides 5 and 35, respectively, of the core ply 3 are covered with a clear vinyl film 67 that has a matte finish on the outside facing surface 69. See FIG. 3. The matte finish is designed to accept handwritten information. If the information is written in ink, it will become a permanent part of the indexing card 1. On the other hand, if the information is written in pencil, it can be readily erased and replaced with new information when desired.

The matte finish need not cover the entire areas of the outside surfaces 69 of the films 67. Rather, the heading 13 above column 9; the headings above the arrays 15, 41, and 45; and heading 60 may be covered with a vinyl film that has a high durability high gloss finish. The card margins can also be laminated with the high gloss film.

The indexing card 1 of the present invention is very simple and convenient to use. A person writes a number or other symbol in each of the spaces 11 and 39 of the front side and back side 5 and 35, respectively. The number entered corresponds to a number assigned to each of the person's video tape cassettes that are to be cataloged on the indexing card. Adjacent an indicia 33 in a column 17 corresponding with the entry in a space 11, the user writes the title of a program recorded on the tape in a cassette. In the columns 19, 21, and 23 he writes the program rating, the person's machine counter number corresponding to the beginning of the program, and the running time, respectively. It is preferred that the user write in the information in pencil. Then, at a later time, when he records different programs over the existing ones on the cassette, he merely erases the penciled information pertaining to the former program. He then writes, in pencil, the information pertaining to the new program. Consequently, the user can continuously update his index of programs in a neat and convenient manner.

Similarly, information pertinent to the calendar portion on the back side 35 can be entered and updated on a regular basis. The user writes in pencil on the matte finish the date, title, times, and channel number in the appropriate columns 47, 49, 51, 53, and 55, respectively. As time passes and the calendared programs are recorded, the information concerning those programs is erased and replaced with information pertaining to new programs to be recorded.

The calibration chart on the back side 35 of the indexing card 1 is used to calibrate the user's machine counter with time. The user writes in each space 65 the counter readout corresponding to each of the time intervals listed. The calibration chart may be completed in ink, provided the user does not anticipate changing equipment.

Thus, it is apparent that there has been provided, in accordance with the invention, a video tape index that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A video tape index comprising a flat piece of thin material having opposed surfaces with matte finishes for erasably receiving selected information written thereon with a lead pencil pertaining to video programs recorded on tape cassettes and for enabling the written information to be erased and rewritten, the piece of material having first and second sides imprinted with indicia comprising:

a. a plurality of vertical and horizontal lines in a grid-like pattern, the lines being arranged to form a first column of vertically aligned spaces and at least one array of four columns adjacent the first column, the array of four columns being divided horizontally into rows in correlation with the spaces in the first column;

b. a heading above the first column of spaces bearing the words Assigned Cassette Number;

c. indicia above the first column of each array of four columns bearing the words Title of Program;

d. indicia above the second column of each array of four columns bearing the word Rating;

e. indicia above the third column of each array of four columns bearing the words Counter Number; and f. indicia above the fourth column of each array of four columns bearing the words Running Time, so that the video tape index displays information pertaining to a person's video programs independent of information on the cassettes or boxes therefor and so that a person can continuously update the information on the video tape index by writing, erasing, and rewriting the information thereon in response to changes in programs recorded on his video tape cassettes without changing any information on the cassettes or boxes therefor.

2. The video tape index of claim 1 wherein the material second side is imprinted with further indicia corresponding to a calendar for recording future video programs comprising:

a. a heading bearing the words Things to Tape; and b. a plurality of vertical and horizontal lines under the heading Things to Tape, the vertical and horizontal lines being arranged to form a grid-like array of rows and columns, there being five columns with respective headings bearing the indicia Day/Date, Title, Start Time, Stop Time, and Channel Number above the respective columns, so that a person can erasably write information relating to future video programs within the calendar.

3. The video tape index of claim 2 wherein the material second side is imprinted with further indicia corresponding to a time calibration chart comprising:

a. indicia bearing the words Time Used on Tape; and b. at least one column of indicia printed under the heading Time Used on Tape bearing predetermined time intervals.

so that a person can erasably write information relating to selected time related events within the time calibration chart.

4. A video tape index for displaying information pertaining to programs recorded on each of a plurality of video tape cassettes comprising:

a. a core ply of thin material printed on a first side with indicia comprising:

i. a plurality of vertical and horizontal lines in a grid-like pattern, the lines being arranged to form a first column of vertically aligned spaces and at least one array of four columns adjacent the first column, the array of four columns being divided horizontally into rows in correlation with the spaces in the first column;

ii. a heading above the first column of spaces bearing the words Assigned Cassette Number;

iii. indicia above the first column of each array of four columns bearing the words Title of Program;

iv. indicia above the second column of each array of four columns bearing the word Rating;

v. indicia above the third column of each array of four columns bearing the words Counter Number; and vi. indicia above the fourth column of each array of four columns bearing the words Running Time; and b. a film of clear material laminated to the core ply first side, the clear material having a matte finish on the outside surface thereof for enabling a person to write selected information with a lead pencil on the matte finish within the columns and rows printed on the core ply first side that corresponds to recorded video programs and for enabling the written information to be erased and replaced with new information.

5. The video tape index of claim 4 wherein:

a. the core ply is printed on a second side with indicia comprising:

i. a plurality of vertical and horizontal lines in a grid-like pattern, the lines being arranged to form a first column of vertically aligned spaces and at least one array of four columns adjacent the first column, the array of four columns being divided horizontally into rows in correlation with the spaces in the first column;

ii. a heading above the first column of spaces bearing the words Assigned Cassette Number;

iii. indicia above the first column of each array of four columns bearing the words Title of Program;

iv. indicia above the second column of each array of four columns bearing the word Rating;

v. indicia above the third column of each array of four columns bearing the words Counter Number; and vi. indicia above the fourth column of each array of four columns bearing the words Running Time; and b. a film of clear material is laminated to the core ply second side, the clear material having a matte finish on the outside surface thereof for enabling a person to write selected information with a lead pencil on the matte finish within the columns and rows printed on the core ply second side that corresponds to recorded video programs and for enabling the written information to be erased and replaced with new information.

6. The video tape index of claim 4 wherein:

a. the core material is printed on the second side with indicia corresponding to a calendar comprising:

i. a heading bearing the words Things to Tape; and ii. a plurality of vertical and horizontal lines under the heading Things to Tape, the vertical and horizontal lines being arranged to form a grid-like array of rows and columns, there being five columns with respective headings bearing the indicia Day/Date, Title, Start Time, Stop Time, and Channel Number above the respective columns;

b. a film of clear material is laminated to the core ply second side over the printed indicia, the clear material having a matte finish on the outside surface thereof for enabling a person to write selected information with a lead pencil on the matte finish within the columns and rows printed on the core ply second side that corresponds to a calendar for recording future video programs and for enabling the written information to be erased and replaced with new information.

7. The video tape index of claim 1 wherein:

a. the core ply is printed on the second side with indicia corresponding with time calibration chart comprising:

i. indicia bearing the words Time Used on Tape; and ii. at least one column of indicia corresponding with time intervals; and b. a film of clear material is laminated to the core ply second side over the printed indicia, the clear material having a matte finish on the outside surface thereof for enabling a person to write selected information with a lead pencil on the matte finish adjacent the time interval indicia corresponding to selected video equipment characteristics and for enabling the written information to be erased and replaced with new information.

* * * * *